US005361518A

United States Patent [19]

Sussmann et al.

[11] Patent Number: 5,361,518

[45] Date of Patent: Nov. 8, 1994

[54] SPORT SHOE WITH AN OUTSOLE WITH HOLDING INSERTS FOR HOLDING GRIPPING ELEMENTS

[75] Inventors: Reinhold Sussmann, Scheinfeld; Theo Hofmann, Schlüsselfeld, both of Germany

[73] Assignee: Tretorn AB, Helsingborg, Sweden

[21] Appl. No.: 127,730

[22] Filed: Sep. 29, 1993

[30] Foreign Application Priority Data

Oct. 31, 1992 [DE] Germany ..... 9214782

[51] Int. Cl.[5] ..... A43C 15/02; A43C 15/16

[52] U.S. Cl. ..... 36/134; 36/67 D

[58] Field of Search ..... 36/134, 127, 126, 128, 36/67 R, 67 D, 59 R

[56] References Cited

U.S. PATENT DOCUMENTS

| | | | |
|---|---|---|---|
| 2,276,887 | 3/1942 | Smith | 36/67 D |
| 2,292,299 | 8/1992 | Smith | 36/67 D |
| 2,412,788 | 12/1946 | Vietas et al. | 36/134 |
| 2,911,738 | 11/1959 | Clerke | 36/134 |
| 3,739,499 | 6/1973 | Morin | 36/134 |
| 4,306,360 | 12/1981 | Hagger | 36/134 |
| 4,470,207 | 9/1984 | Bente | 36/59 R |
| 4,492,047 | 1/1985 | Arff | 36/134 |
| 4,651,448 | 3/1987 | Chen | 36/134 |

FOREIGN PATENT DOCUMENTS

| | | | |
|---|---|---|---|
| 0451379A1 | 10/1991 | European Pat. Off. . | |
| 2313646 | 10/1974 | Germany . | |
| 2405170A1 | 8/1975 | Germany . | |
| 3026452 | 2/1982 | Germany | 36/128 |
| 3924360A1 | 1/1991 | Germany . | |
| 4014064A1 | 7/1991 | Germany . | |
| 4014064 | 11/1991 | Germany | 36/124 |

*Primary Examiner*—Steven N. Meyers

*Attorney, Agent, or Firm*—Sixbey, Friedman, Leedom & Ferguson

[57] ABSTRACT

A sport shoe with an outsole cleat-type gripping element is constructed so that, even in an inclined position of the outsole, the supporting areas of the gripping element or elements have as complete a ground contact as possible, without the gripping element being damaged or destroyed by excessive lateral forces. Further, the damping property of the gripping element can be matched in a simple way to the respective requirements. In particular, in accordance with a preferred embodiment of the invention these characteristics are obtained by providing a receiving device, which has an inside thread for receiving the threaded bolt for at least one gripping element, in a holding insert that is embedded in the outsole, the receiving device being mounted so as to be both axially movable and slightly tiltable laterally without being able to rotate.

19 Claims, 2 Drawing Sheets

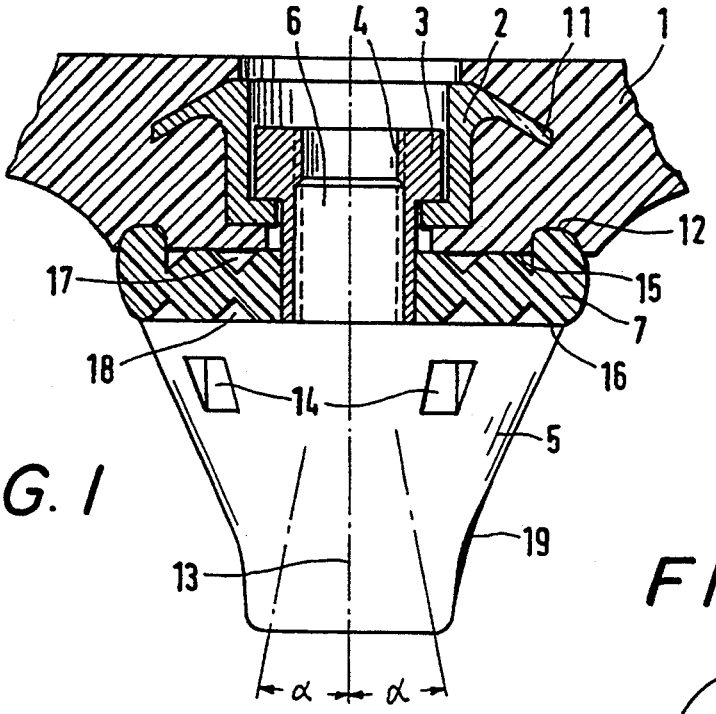
FIG. 1
FIG. 3a
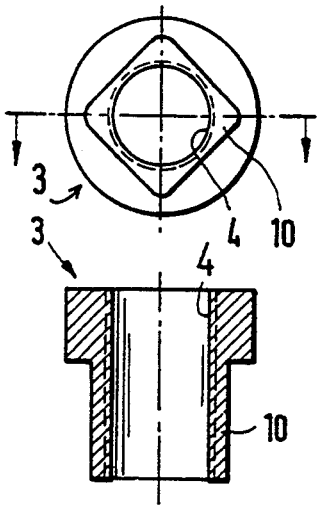
FIG. 3b
FIG. 2a
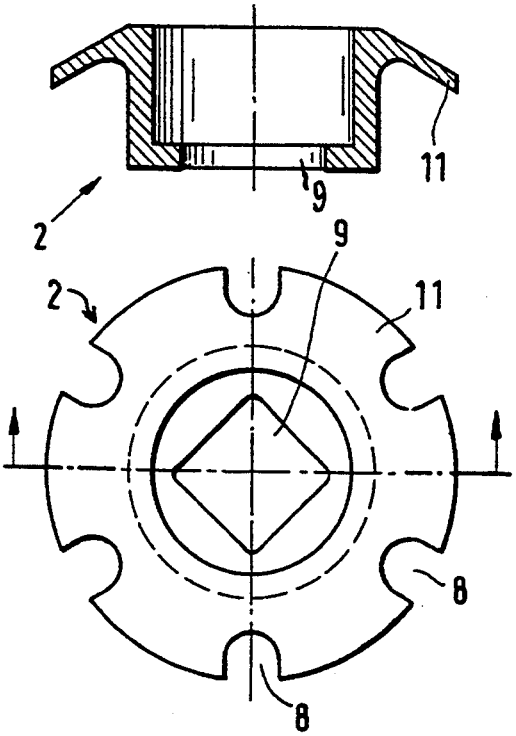
FIG. 2b
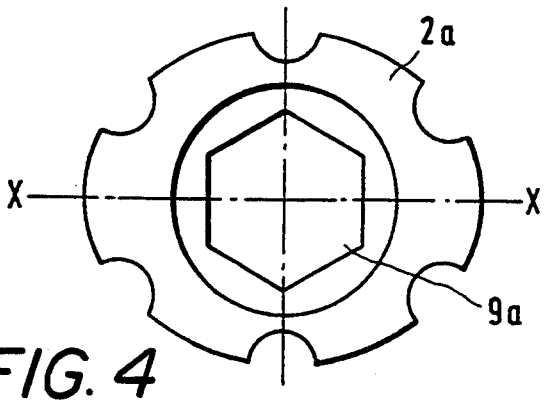
FIG. 4

SPORT SHOE WITH AN OUTSOLE WITH HOLDING INSERTS FOR HOLDING GRIPPING ELEMENTS

BACKGROUND OF THE INVENTION

The invention relates to a sport shoe with an outsole with holding inserts embedded in it for holding replaceable gripping elements provided with a threaded bolt, and a damping element for flexible support of the gripping element is placed on the outsole between the outsole and at least one gripping element.

A sport shoe outsole with the above-indicated features is known from German Offenlegungsschrift 40 14 064. This outsole comprises integrally molded projections, and in a recess of each projection, a holding insert for a gripping element is held so as to be axially movable to a limited extent. The gripping element is supported on the front side of the assigned projection by a damping element. The holding insert and the gripping element are, in this case, matched to the corresponding cylindrical inside walls of the recess, and in this way, are laterally rigid so that, for example, lateral forces occurring in an inclined position of the sport shoe are imparted to the foot in an undamped manner, which often leads to injuries.

This defect is corrected in the case of a cleat known from German Offenlegungsschrift 23 13 646. In this case, a gripping element for a sport shoe, which has a holding pin used for its fastening to the outsole, preferably by screwing in, uses a cleat that consists of a holding part carrying the holding pin and a supporting part designed for being supported on the bottom, and an intermediate element is placed between these parts, which makes possible an elastic movement of the supporting part, both in a direction perpendicular to the outsole area and crosswise to it. The intermediate element consists, for example, of rubber and is connected with at least one of these parts, preferably by prevulcanization.

In this known cleat, the movable part is relatively small, so that in an excessive deflection of this part, the elastic intermediate element is greatly stressed and can be damaged or destroyed. Further, the damping property of a finished cleat cannot be changed later. Therefore, numerous cleats with various damping properties would have to be produced and kept available to be able to replace them, if necessary, as a whole.

SUMMARY OF THE INVENTION

The primary object of the present invention is to improve a sport shoe with an outsole and corresponding gripping elements of the initially mentioned type so that, even in an inclined position of the outsole, the supporting areas of the gripping element or elements, for example, of a cleat, have as complete a ground contact as possible, without the gripping element being damaged or even destroyed by excessive lateral forces. Further, the damping property of the gripping element can be matched in a simple way to the respective requirements.

This object is achieved in accordance with a preferred embodiment of the invention by providing a receiving device in the holding insert embedded in the outsole which has an inside thread for receiving the threaded bolt for at least one gripping element, this receiving device being mounted so as to be both axially movable and slightly tiltable laterally.

Here, it is advantageous that the receiving device for the gripping element is axially movable in the range of 1 mm to 3 mm and is tiltable by an angle $\alpha$ in the range of 3° to 20° around the axis of rotation.

According to another embodiment of the invention, the damping property of the damping element placed between the outsole and the gripping element that can be screwed in is adjustable by selection of the hardness of its material and/or by selection of its structure.

The advantages achieved with the invention consist especially in the fact that when the foot is inclined, i.e., in an inclined position of the outsole, the supporting areas of the gripping element or elements, for example, that of a cleat, have a ground contact that is complete at least as much as possible, without the gripping element being damaged or even destroyed by excessive lateral forces. Furthermore, the damping property of the gripping element can be changed in a simple way, namely, by exchanging one damping element for another damping element of a different hardness, and thus, a different damping property. Additionally, by a special design of the damping element, penetration of dirt into the joint between the damping element and the outsole is avoided. Injuries, especially pulled ligaments or torn ligaments of the wearers of such sport shoes, in particular on hard and/or uneven ground, coverings or the like are, therefore, clearly reduced.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 1 shows a portion of an outsole with an embedded holding insert and receiving device mounted in it, and with a screwed-in gripping element, partially in section;

FIGS. 2*a* and 2*b* are sectional and top views of a holding insert;

FIGS. 3*a* and 3*b* are bottom and cross-sectional views of a receiving device for the gripping element;

FIG. 4 is a bottom view of a modification of the receiving device for the gripping element according to FIG. 2*b.

DETAILED DESCRIPTION OF THE PREFERRED EMBODIMENT

Figure 5:
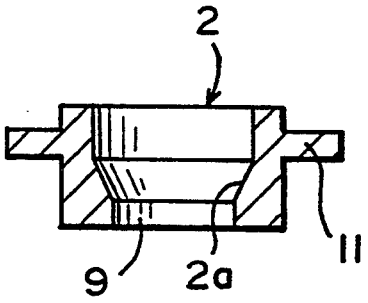
* and FIGS. 5 and 6 show a modified embodiment of the holding insert and receiving device in views corresponding to those of FIGS. 2*a* and 3*b,* respectively.

In FIG. 1, a shoe sole, especially the outsole of a sport shoe, for example a soccer, hockey or European field handball shoe, is designated with numeral 1. This outsole, in general, is formed of a single piece made of an injection-molded or cast plastic, such as polyurethane, polyethylene, polyamide or the like, and extends over the entire length of the shoe. Gripping elements are distributed on this outsole in a known way, for example corresponding to the stress profile of the sole and/or the necessary gripping capacity of the sport shoe on a specific playing field.

At least one of these gripping elements, preferably one of the gripping elements placed along the lateral side of the instep, has the properties according to the invention described below:

In outsole 1, a holding insert 2 for holding replaceable gripping elements 5 have a flange 11 that is permanently injection-molded or cast into it. In this holding insert 2, a receiving device 3 with an inside thread 4 is provided for retaining a gripping element 5 that is provided with a correspondingly threaded bolt 6. Receiving device 3 is mounted so as to be axially movable by about 1–3 mm and to tilt laterally by an angle $\alpha$ in the range of 3° to 20° around axis of rotation 13. That is, as can be seen from FIG. 1, holding insert 2 forms a receptacle in which an upper end of the receiving device 3 is disposed with a circumferential clearance between the periphery of the receiving device 3 and a surrounding wall of the holding insert 2 in which it is disposed and between an opening in a bottom wall of the receptacle and a lower portion of the receiving device 3 which extends therethrough. Additionally, an axial clearance is provided between atop end of the receptacle and a top surface of said upper end of the receiving device 3. These clearances, together with a circular damping element 7 (described more fully below) enable the receiving device to be both axially movable and laterally tiltable relative to holding insert 2 to the indicated extent.

The circular damping element 7 is placed between outsole 1 and gripping element 5 to achieve a resilient supporting of gripping element 5 on the outsole 1. The damping property of this damping element 7, preferably consisting of compact or foam rubber, or of compact or foam plastic with rubber elastic properties, such as silicon or other resiliently flexible plastics, can be adjusted by selection of the hardness of its material (preferably, 25 to 75 Shore D) and/or by selection of its structure. This damping element 7 should be prestressed by gripping element 5 being screwed tightly into receiving device 3 so as to compress the damping element 7 by a certain measurement, e.g., at least by 0.5 ram, to assure that it seats sufficiently tightly on the outsole 1.

It is also advantageous if damping element 7 has one or more notches 17 or 18 on its top and/or bottom side 15 or 16. Advantageously, notches 17 or 18 represent circumferential indentations, and these notches 17 or 18 are coaxial with respect to the longitudinal center axis 13 of gripping element 5 and receiving device 3.

So that no dirt can penetrate the joint between damping element 7 and outsole 1, damping element 7 has a circular bead 12 on its peripheral edge which rises in an axial direction. Bead 12 engages in a corresponding groove provided in outsole 1, coaxial to center axis 13 of gripping element 5.

According to a modified embodiment, it is considered advantageous to mold the material of outsole 1 directly on the damping element or elements. In this case, the circular bead or beads 12 can be omitted.

Holding insert 2 is integrally cast or molded-in by the material of outsole 1 to protect its shape against torsional effects. In FIG. 2*a* and 2*b*, the shape of the holding insert 2 is represented, and from which it can be seen that flange 11 is provided on its upper peripheral edge with notches 8 which receive the material of the sole and serve to prevent rotation of the holding insert within the sole. Receiving device 3, represented in FIGS. 3*a* and 3*b*, is mounted in holding insert 2 in a manner which prevents it from rotating under the influence of torsional forces applied to the gripping element 5. This is achieved by providing receiving device 3 with a square part 10 on its side which faces gripping element 5 and having it pass through a square opening 9 of holding insert 2. In FIG. 2*b*, holding insert 2 is represented in top view as a circular part with a square opening 9 for square part 10 of receiving device 3.

In a modified embodiment represented in FIG. 4, the holding insert 2 is an elliptical part 2*a* with a major elliptical axis, for example in the X—X plane, and in this embodiment its opening 9*a* is designed as a hexagon or other polygon. The elliptical shape serves to further resist twisting of the holding insert 2 under imposed torsional forces.

It is also possible to provide other noncircular shaped openings and to design the surface of receiving device 3 complementarily thereto so that both parts are held in one another in a manner that protects against torsional effects instead of using the square opening 9 of the holding insert 2 represented in FIG. 2*b* or the hexagonal shape of FIG. 4.

Figure 6:
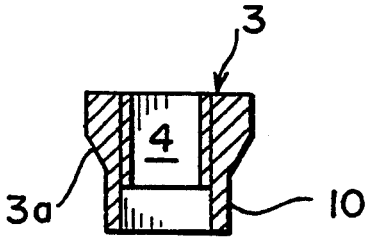

Furthermore, in accordance with the preferred embodiment of FIGS. 5 and 6, the holding insert 2 has a frustoconical, tapered inner surface 2*a* for receiving the similarly shaped surface 3*a* of receiving device 3. Such an arrangement provides the advantage that, even with when the receiving device tilt laterally by the angle $\alpha$, due to the frustoconically-shaped surfaces 2*a*, 3*a*, a large surface pressure distribution is obtained since most of the frustoconical surfaces still fit against each other. This is in contrast to the embodiment of FIGS. 1–3, wherein the stresses that result when the receiving device 3 flits relative to the holding insert 2 are substantially concentrated. FIGS. 5 and 6 also show a modified shape and location for the integral flange 11.

While holding insert 2 is produced from metal, preferably from steel, or from fiber-reinforced plastic, receiving device 3 is preferably formed of steel or of aluminum.

Gripping elements 5 are provided with recesses 14 on their peripheral surface which can be engaged by the corresponding counterparts of a key with which gripping elements 5 can be screwed down or unscrewed, as is known.

In sport shoes provided with cleats, such as soccer shoes, European field handball shoes, field hockey shoes or the like, the inventive cleats are preferably attached in the lateral side area of the outsole, especially in the front sole area to avoid as much as possible overextension of the ligaments or worse injuries by twisting toward the outside. In a corresponding way, these cleats are preferably also provided in the lateral side area at the rear of the sole. For especially disadvantageous ground conditions, especially on hard and/or uneven subsoil, it is considered advantageous to configure all gripping elements, especially cleats, according to the invention.

The axial movement of receiving device 3, upward in the direction toward the inside of the shoe, can be limited by damping element 7, but in addition, by a relatively hard insole, as it is usually used in such sport shoes.

The cleats have a conical tread surface that tapers downward and can be provided with a reinforcement 19 in a lengthwise direction of the tread surface (see FIG. 1, right side) where a concave peripheral surface is formed. This has the advantage of rendering the cleats more stable under forces acting laterally.

While various embodiments in accordance with the present invention have been shown and described, it is understood that the invention is not limited thereto, and is susceptible to numerous changes and modifications as known to those skilled in the art. Therefore, invention is not limited to the details shown and described herein, and includes all such changes and modifications as are encompassed by the scope of the appended claims.

We claim:

1. Sport shoe with an outsole with holding inserts embedded therein for holding replaceable gripping elements provided with a threaded bolt, and a damping element for resiliently supporting the gripping element on the outsole, said damping element being located between the outsole and at least one gripping element; wherein at least one of the holding inserts is embedded in the outsole and has a receiving device for a gripping element; wherein the at least one holding insert forms a receptacle in which an upper end of the receiving device is disposed with a circumferential clearance between the periphery of the receiving device and a surrounding wall of the holding insert in which it is disposed and between an opening in a bottom wall of the receptacle and a lower portion of the receiving device which extends therethrough, and with an axial clearance between a top end of the receptacle and a top surface of said upper end of the receiving device, said clearances forming, together with said damping element, a means for enabling the receiving device to be both axially movable and laterally tiltable relative to said at least one holding insert; and wherein the receiving device is provided with an inside thread for receiving the threaded bolt.

2. Sport shoe according to claim 1, wherein the damping element is one of a plurality of damping elements that are selectively interchangeable and which have different damping properties.

3. Sport shoe according to claim 1, wherein the damping element is formed of a material from the group consisting of compact and foam rubbers and compact and foam plastics having rubber elastic properties.

4. Sport shoe according to claim 3, wherein the hardness of the damping element is 25 to 75 Shore D.

5. Sport shoe according to claim 1, wherein the damping element has at least one notch on at least one of top and bottom sides thereof.

6. Sport shoe according to claim 5, wherein the at least one notch is comprised of a peripheral indentation.

7. Sport shoe according to claim 5, wherein the at least one notch runs coaxially with respect to a central longitudinal axis of the gripping element.

8. Sport shoe according to claim 1, wherein the damping element is prestressed, as a result of tightening of the gripping element within the receiving device, by being compressed at least 0.5 min.

9. Sport shoe according to claim 1, wherein the damping element has a circular bead on an outside edge thereof, said bead rising in an axial direction and engaging in a corresponding groove provided in the outsole coaxial with respect to a central longitudinal axis of the gripping element.

10. Sport shoe according to claim 1, wherein the material of outsole is directly molded onto the damping element.

11. Sport shoe according to claim 1, wherein the holding insert has a torsionally resistant shape.

12. Sport shoe according to claim 11, wherein the holding insert has notches on a peripheral edge thereof.

13. Sport shoe according to claim 11, wherein the receiving device is mounted in the holding insert in a manner preventing relative rotation therebetween.

14. Sport shoe according to claim 13, wherein the receiving device is a square part which extends through a square opening in the holding insert.

15. Sport shoe according to claim 13, wherein the opening in the holding insert has a polygonal cross-sectional shape which interfits with a surface of the receiving device in a manner holding against relative displacement due to torsional forces acting on the gripping element.

16. Sport shoe according to claim 1, wherein holding insert is formed of a material selected from the group consisting of metal, plastic, and fiber-reinforced plastic.

17. Sport shoe according to claim 16, wherein receiving device is formed of a material selected from the group consisting of steel or aluminum.

18. Sport shoe according to claim 1, wherein the gripping element has the shape of a cleat of the type used for soccer, European field handball, and field hockey.

19. Sport shoe according to claim 1, wherein gripping elements provided with a damping element are placed at least in an area along a lateral side of an instep area of the sole.

* * * * *